US009362682B2

(12) United States Patent
Chien et al.

(10) Patent No.: US 9,362,682 B2
(45) Date of Patent: Jun. 7, 2016

(54) MICRO ELECTRONIC PLUG CONNECTOR

(71) Applicant: ADVANCED-CONNECTEK INC., New Taipei (TW)

(72) Inventors: Min-Lung Chien, New Taipei (TW); Ming-Yung Chang, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 14/706,741

(22) Filed: May 7, 2015

(65) Prior Publication Data

US 2015/0325955 A1 Nov. 12, 2015

(30) Foreign Application Priority Data

May 8, 2014 (TW) ..... 103208029 U

(51) Int. Cl.
*H01R 13/659* (2011.01)
*H01R 13/502* (2006.01)

(52) U.S. Cl.
CPC ..... *H01R 13/659* (2013.01); *H01R 13/502* (2013.01)

(58) Field of Classification Search
CPC .. H01R 12/724; H01R 13/659; H01R 13/502; H01R 13/6581
USPC ..... 439/607.25, 607.23, 607.24, 607.18, 439/607.05, 607.12, 607.55, 607.01
See application file for complete search history.

(56) References Cited
U.S. PATENT DOCUMENTS

| | | | | |
|---|---|---|---|---|
| 6,939,177 | B2 * | 9/2005 | Kato | H01R 27/02 439/607.01 |
| 7,850,477 | B2 * | 12/2010 | Koyama | H01R 27/02 439/358 |
| 7,946,887 | B1 * | 5/2011 | Zhang | H01R 27/02 439/607.23 |
| 8,011,959 | B1 * | 9/2011 | Tsai | H01R 13/6275 439/541.5 |
| 8,011,960 | B2 * | 9/2011 | Xiao | H01R 27/02 439/607.24 |
| 8,118,497 | B2 * | 2/2012 | Yi | G02B 6/3817 385/88 |
| 8,123,562 | B2 * | 2/2012 | Zhou | H01R 9/032 439/607.48 |
| 8,162,694 | B2 * | 4/2012 | Hisada | H01R 27/00 439/358 |
| 8,241,064 | B2 * | 8/2012 | Ohtsuji | H01R 12/724 439/345 |
| 8,328,579 | B2 * | 12/2012 | Sasaki | H01R 13/659 439/607.25 |
| 8,672,711 | B2 * | 3/2014 | Kondo | H01R 12/57 439/607.1 |
| 2011/0312217 | A1 * | 12/2011 | Xiao | H01R 27/02 439/607.23 |

* cited by examiner

*Primary Examiner* — Abdullah Riyami
*Assistant Examiner* — Harshad Patel
(74) *Attorney, Agent, or Firm* — Muncy, Geissler, Olds & Lowe, P.C.

(57) ABSTRACT

A micro electronic plug connector includes an insulation housing, a first terminals, a second terminals, a metal shell and a connecting portion. The insulation housing includes a base member, a first tongue plate and a second tongue plate. The first and second tongue plates are extended from one side of the base member. The first and second terminals are disposed at the first and second tongue plates, respectively. The metal shell encloses the insulation housing and includes top and bottom lateral walls arranged with each other to form first and second frame windows. The bottom lateral wall includes a protruding portion, which includes a top plane adjacent to the top lateral wall, disposed between the first and second frame windows. An interval is defined between the top lateral wall and the top plane for disposing the connecting portion.

8 Claims, 5 Drawing Sheets

MICRO ELECTRONIC PLUG CONNECTOR

CROSS-REFERENCES TO RELATED APPLICATIONS

This non-provisional application claims priority under 35 U.S.C. §119(a) on Patent Application No. 103208029 filed in Taiwan, R.O.C. on 2014 May 8, the entire contents of which are hereby incorporated by reference.

FIELD OF THE INVENTION

The disclosure relates to an electronic connector, and particularly to a micro electronic plug connector.

BACKGROUND

USB, universal serial bus, is a common electronic connector interface applied to electronic devices; additionally, the Micro USB electronic connector interface is smaller than the conventional USB electronic connector, and therefore more conveniently carried, and is applied to the connecting holes and the data transfer cables of smart mobile devices, digital cameras, or other handheld electronic devices.

The USB 3.0 electronic connector includes the Micro-B type electronic connector. In contrast with the Standard-A type USB electronic connector, the Micro-B electronic connector is capable of being assembled with smart mobile devices or other handheld electronic devices; additionally, the USB 3.0 electronic connector has downward compatibility so as to be compatible with the USB 2.0 electronic connector.

The housing of the conventional micro electronic plug connector includes two inserting windows corresponding to the two inserting windows of the micro electronic receptacle connector and capable of transmitting USB 3.0 signals and USB 2.0 signals, respectively. However, there is no connecting structure between the two inserting windows; that is, the top side and the bottom side between the two inserting windows are not connected with each other. Consequently, upon being connected to the micro electronic receptacle connector, the housing of the micro electronic plug connector is prone to be deformed and damaged when the top side or the bottom side is forced (or pressed).

Additionally, upon being connected to the micro electronic receptacle connector, the USB 3.0 signals is transmitted by the USB 3.0 terminals in one of the two inserting windows, and the USB 2.0 signals is transmitted by the USB 2.0 terminals in the other inserting window. However, since the top side and the bottom side between the two inserting windows are not connected with each other, upon transmitting signals, the USB 3.0 terminals and the USB 2.0 terminals interfere with each other electromagnetically, resulting in the electromagnetic interference (EMI) problems. Therefore, how to improve the structure of the conventional micro electronic plug connector is a topic to be urgently addressed by the inventor of the disclosure and persons engaged in the technical field of the relevant industry.

SUMMARY OF THE INVENTION

In view of this, the disclosure provides a micro electronic plug connector including an insulation housing, a first terminals, a second terminals, a metal shell and a connecting portion. The insulation housing includes a base member, a first tongue plate and a second tongue plate. The first and second tongue plates are extendingly formed at one side of the base member. The first terminals is disposed at the first tongue plate, and the second terminals is disposed at the second tongue plate. The metal shell encloses the insulation housing and includes a top lateral wall and a bottom lateral wall. The bottom lateral wall is arranged side by side with the top lateral wall to form a first frame window and a second frame window. The first tongue plate is received in the first frame window, and the second tongue plate is received in the second frame window. The bottom lateral wall includes a protruding portion disposed between the first frame window and the second frame window. The protruding portion includes a top plane adjacent to the top lateral wall. An interval is defined between the top lateral wall and the top plane. The connecting portion is disposed at the interval. The top lateral wall and the top plane are connected with each other through the connecting portion.

Based on the above, in the disclosure, the connecting portion is applied to connect the top lateral wall with the top plane, thus preventing the top lateral wall or the bottom lateral wall from being deformed or damaged; that is, with the connection of the connecting portion, the top lateral wall and the bottom lateral wall are integrally formed as a whole to strengthen the structural strength between the top lateral wall and the bottom lateral wall and to improve the overall strengths of the first frame window and the second frame window. Additionally, the connecting portion absorbs and grounds the electronic interference generated upon transmitting USB 3.0 and USB 2.0 signals, and prevents from the EMI problems upon transmitting USB 3.0 and USB 2.0 signals simultaneously.

The detailed features and advantages of the disclosure are described below in great detail through the following embodiments; the content of the detailed description is sufficient for those skilled in the art to understand the technical content of the disclosure and to implement the disclosure there accordingly. Based upon the content of the specification, the claims, and the drawings, those skilled in the art can easily understand the relevant objectives and advantages of the disclosure.

BRIEF DESCRIPTION OF THE DRAWINGS

The disclosure will become more fully understood from the detailed description given herein below for illustration only and thus not limitative of the disclosure, wherein.

DETAILED DESCRIPTION

Figure 1:
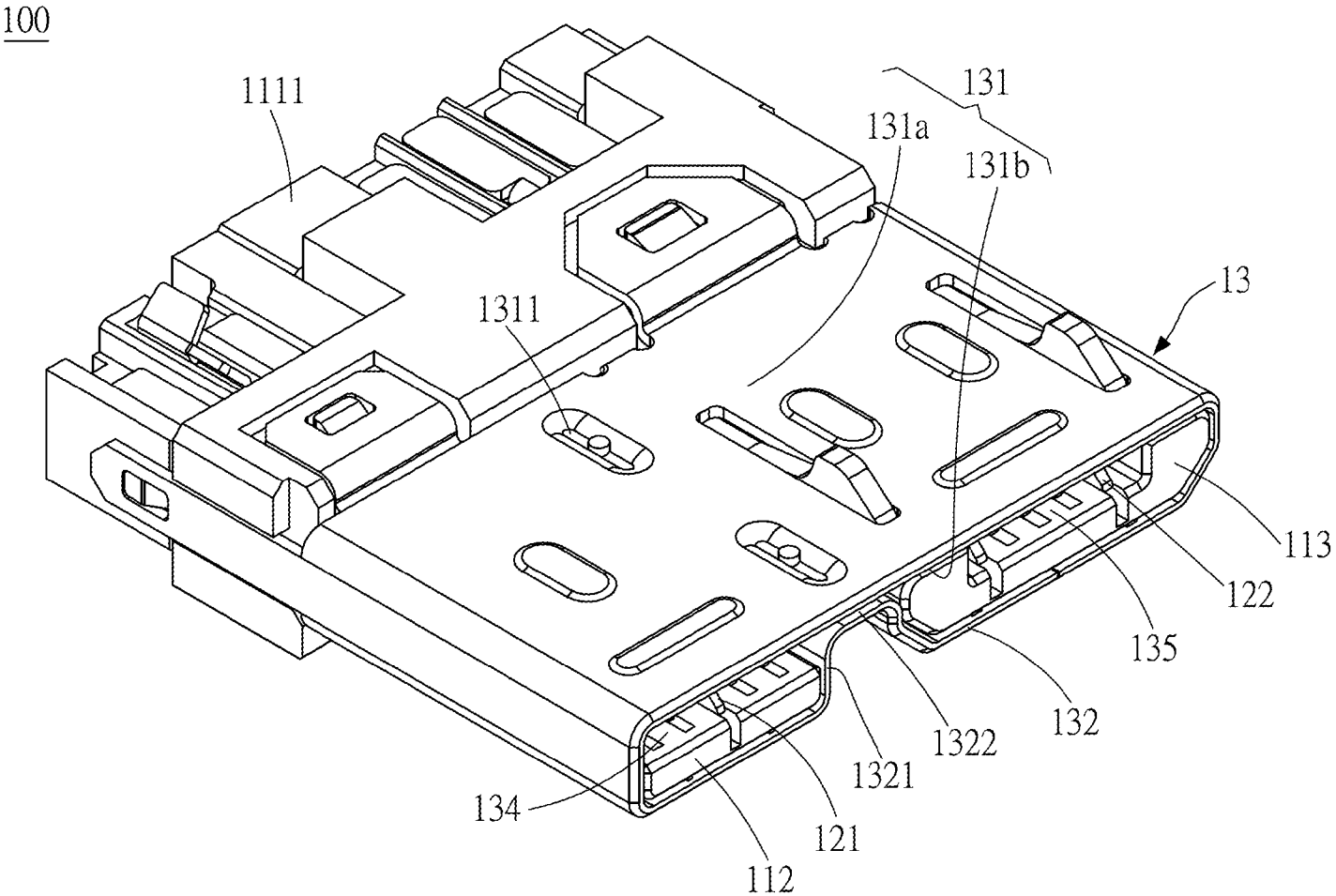
FIG. 1 is a perspective view of a micro electronic plug connector of one embodiment of the disclosure.
Figure 2:
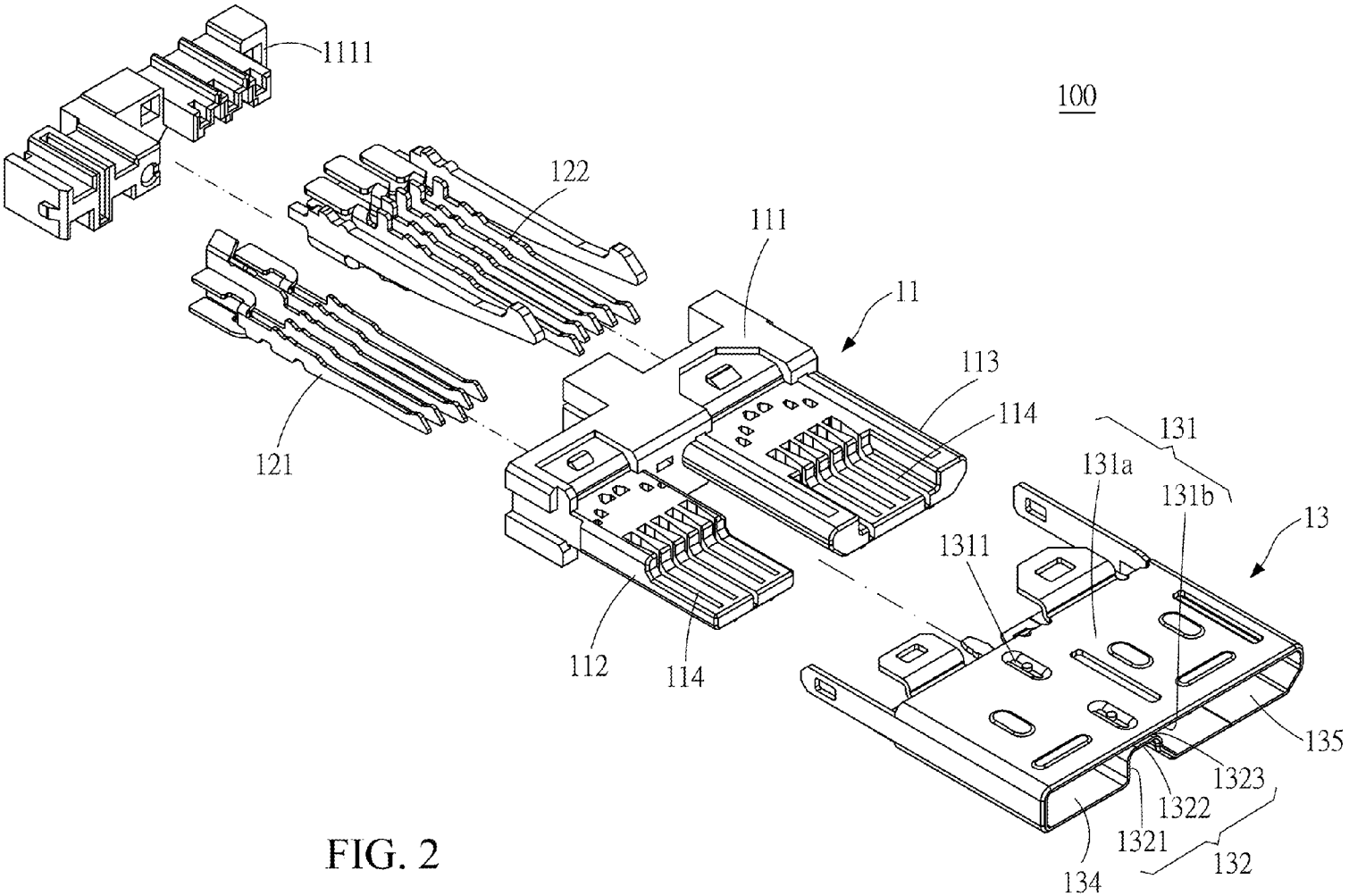
FIG. 2 is an exploded view of the micro electronic plug connector of the embodiment of the disclosure.
Figure 3:
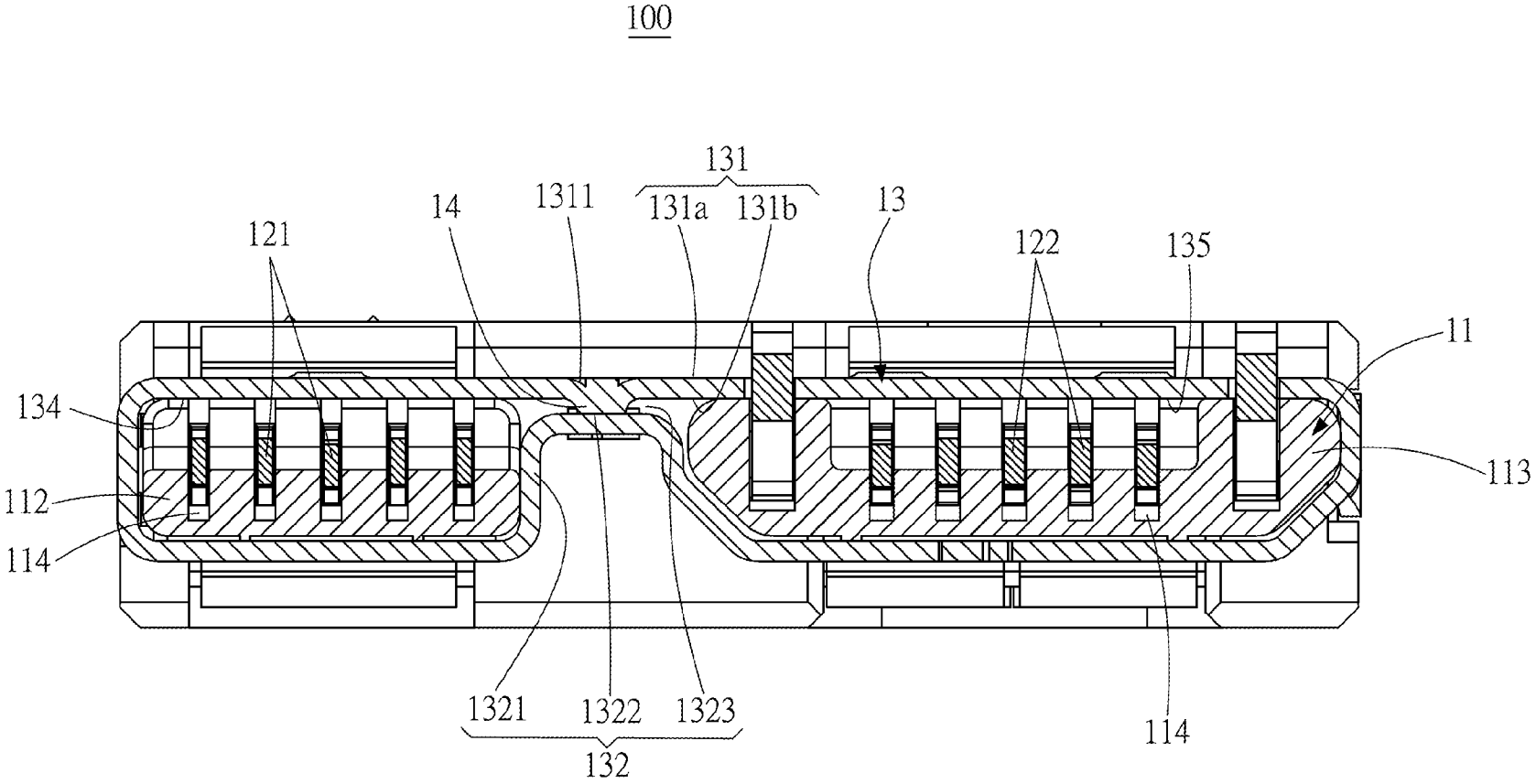
FIG. 3 is a sectional view of the micro electronic plug connector of the embodiment of the disclosure.
Figure 4:
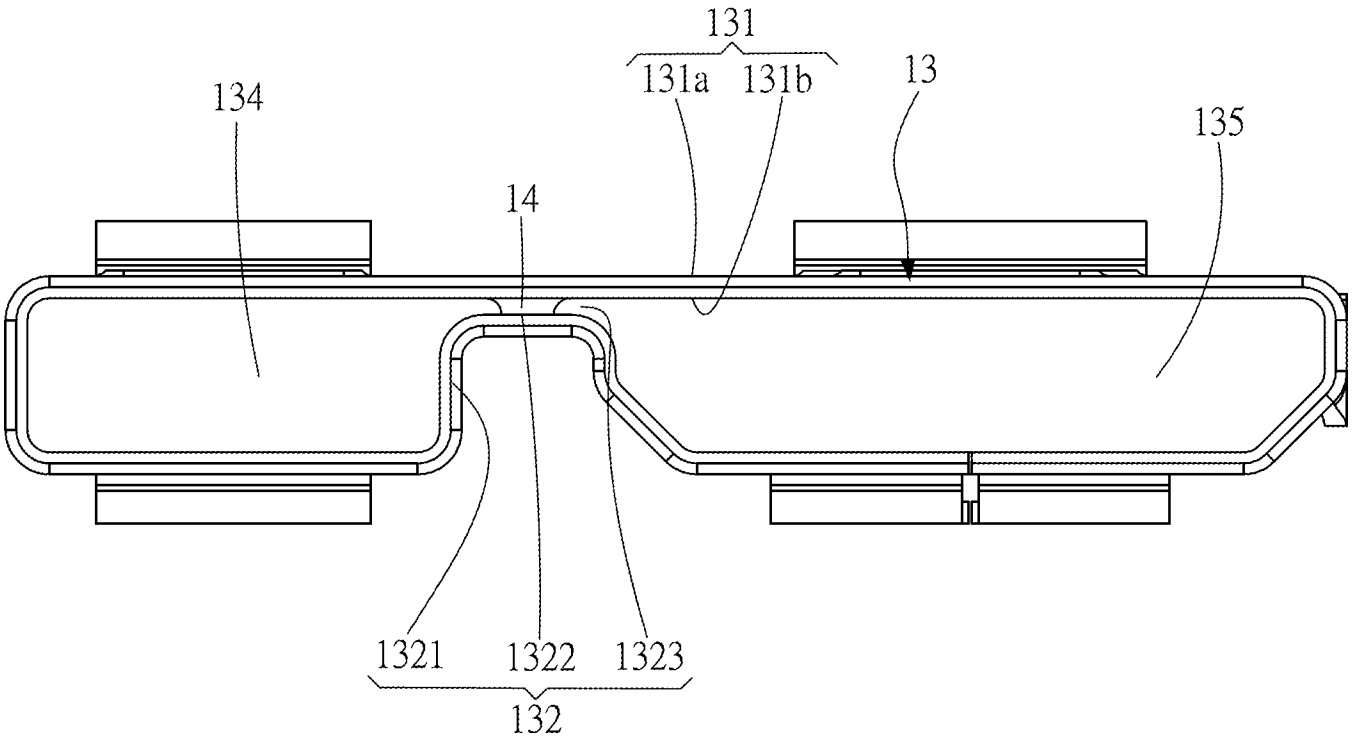
FIG. 4 is a schematic front view (1) of a metal shell of the micro electronic plug connector of the embodiment of the disclosure.

Please refer to FIG. 1, FIG. 2, FIG. 3 and FIG. 4, which illustrate a micro electronic plug connector 100 of one embodiment of the disclosure; FIG. 1 is a perspective view, FIG. 2 is an exploded view, FIG. 3 is a sectional view and FIG. 4 is a schematic front view the micro electronic plug connector 100 of the embodiment of the disclosure. The micro electronic plug connector 100 complies with the interface for transmitting USB 3.0, USB 2.0, RF, or digital signals. Particularly, the USB 3.0 comply with the specification of Micro-B type electronic connector. In the disclosure, the micro electronic plug connector 100 includes an insulation housing 11, a first terminals 121, a second terminals 122, a metal shell 13 and a connecting portion 14.

The insulation housing 11 includes a base member 111, a first tongue plate 112 and a second tongue plate 113. Here, the insulation housing 11 includes terminal grooves 114 formed thereon to assemble with the first terminals 121 and the second terminal 122, but embodiments are not limited thereto. In some implementation aspects, the insulation housing 11 includes the base member 111, the first tongue plate 112 and the second tongue plate 113 formed thereon by injection-molding, for assembling with the first terminals 121 and the second terminals 122. In this embodiment, the first tongue plate 112 and the second tongue plate 113 are extendingly formed at one side of the base member 111; besides, one side of the base member 111 includes a terminal base 1111 provided for fastening with the first terminals 121 and the second terminals 122.

The first terminals 121 are used for transmitting USB 3.0 signals (or for transmitting radiofrequency (RF) signals). The first terminals 121 are disposed at the first tongue plate 112. In some implementation aspects, the first terminals 121 and the second terminals 122 mutually transmit USB 3.0 signals. The first terminals 121 includes a plurality of high frequency transmission terminal pairs, each of the high frequency transmission terminal pairs are adjacent to each other.

The second terminals 122 are used for transmitting USB 2.0 signals (or for transmitting digital signals). The second terminals 122 are disposed at the second tongue plate 113 and provided for transmitting USB 2.0 signals.

The metal shell 13 is a hollow shell enclosing the insulation housing 11. The metal shell 13 includes a top lateral wall 131 and a bottom lateral wall 132. The bottom lateral wall 132 is arranged side by side with the top lateral wall 131 and disposed at a bottom portion of the top lateral wall 131. A first frame window 134 and a second frame window 135 are formed between the top lateral wall 131 and the bottom lateral wall 132. The first tongue plate 112 is received in the first frame window 134 and the second tongue plate 113 is received in the second frame window 135. Additionally, the bottom lateral wall 132 includes a protruding portion 1321 disposed between the first frame window 134 and the second frame window 135. The protruding portion 1321 is recessed toward the top lateral wall 131. The protruding portion 1321 includes a top plane 1322. The top plane 1322 is adjacent to the top lateral wall 131 and an interval 1323 is defined between the top lateral wall 131 and the top plane 1322.

The connecting portion 14 is disposed at the interval 1323 between the top plane 1322 and the top lateral wall 131. The top plane 1322 and the top lateral wall 131 are connected with each other through the connecting portion 14.

Upon connected to a micro electronic receptacle connector (not shown), the metal shell 13 of the micro electronic plug connector 100 is forced, the connecting portion 14 connected between the top lateral wall 131 and the top plane 1322 prevents the top lateral wall 131 or the bottom lateral wall 132 from being deformed and damaged. That is, the top lateral wall 131 and the bottom lateral wall 132 are integrally formed as a whole, with the connection of the connecting portion 14, the structural between the top lateral wall 131 and the bottom lateral wall 132 is strengthened and the overall strengths of the first frame window 134 and the second frame window 135 is improved, so the metal shell 13 of the micro electronic plug connector 100 is prevented from being deformed and damaged.

Additionally, upon connected to the micro electronic plug connector, the first terminals 121 in the first frame window 134 transmit USB 3.0 signals (or RF signals), and the second terminals 122 in the second frame window 135 transmit USB 2.0 signals (or digital signals), thereby the connecting portion 14 between the top lateral wall 131 and the top plane 1322 absorbing and grounding the electromagnetic interference (EMI) generated upon transmitting USB 3.0 and USB 2.0 signals simultaneously.

Please refer to FIG. 4 again, in which in some implementation aspects, the top lateral wall 131 is formed as the connecting portion 14 using laser welding; that is, by using the laser welding technique, an outer wall 131*a* of the top lateral wall 131 is connected to the protruding portion 1321 of the bottom lateral wall 132, thus the connecting portion 14 is formed between the top plane 1322 of the protruding portion 1321 and an inner wall 131*b* of the top lateral wall 131. Here, the connecting portion 14 is a rod shaped structure connected between the top plane 1322 and the inner wall 131*b*; that is, the connecting portion 14 blocks the first frame window 134 and the second frame window 135, so that the first frame window 134 is not connected with the second frame window 135, thereby improving the structural strength of the micro electronic plug connector 100 and reducing EMI.

Please refer to FIG. 1 and FIG. 3 again, in which in some implementation aspects, the top lateral wall 131 further includes a plurality of recessed portions 1311 adjacent to the top plane 1322. A distance between each of the recessed portions 1311 and the top plane 1322 is smaller than the interval 1323; that is, the top lateral wall 131 is extended downwardly toward the top plane 1322 through the recessed portions 1311. Additionally, laser welding is applied to be aimed to the recessed portions 1311 of the outer wall 131*a* of the top lateral wall 131, thus a plurality of connecting portions 14 are formed between the top plane 1322 of the protruding portion 1321 and the inner wall 131*b* of the top lateral wall 131. Here, the connecting portions 14 form as the structures for blocking the first frame window 134 and the second frame window 135, and channels connected with each other are formed between the connecting portions 14. Here, the connecting portions 14 also provide the functions for improving the structural strength of the micro electronic plug connector 100 and reducing EMI.

Figure 5:
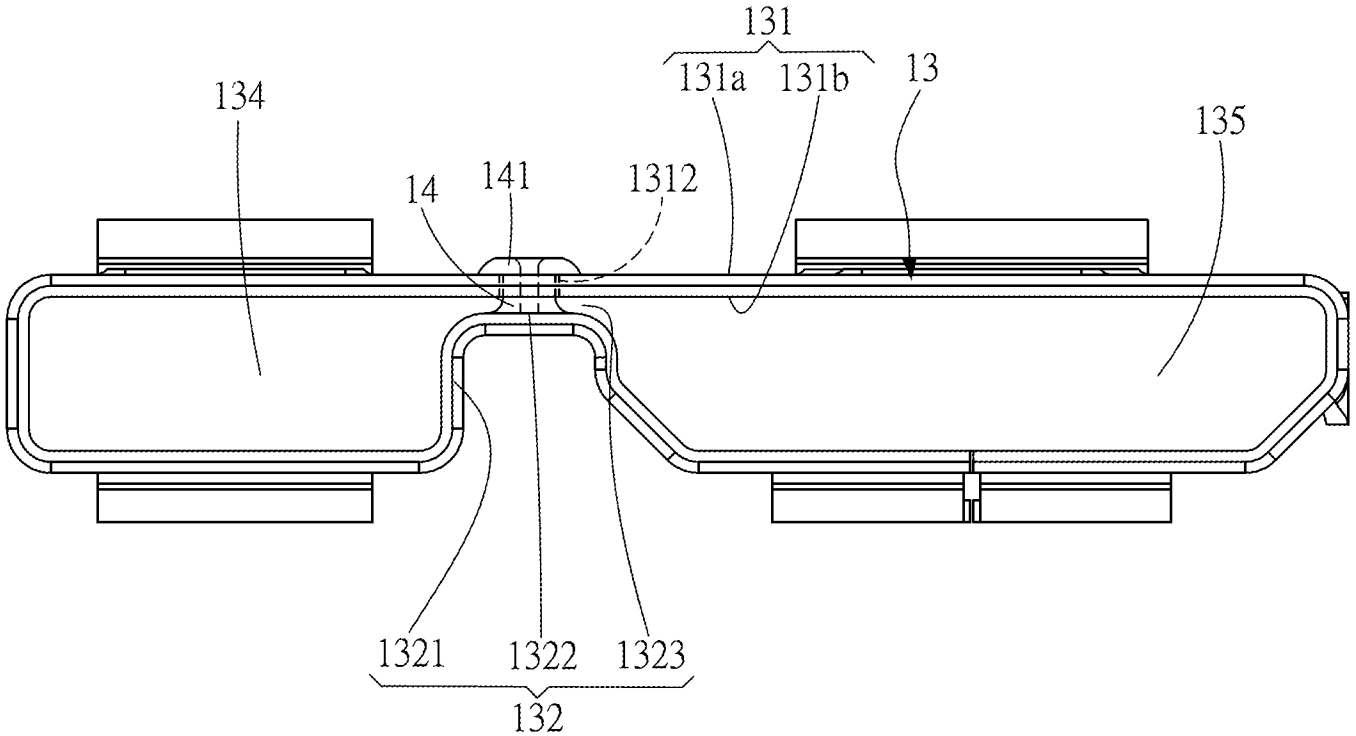
FIG. 5 is a schematic front view (2) of the metal shell of the micro electronic plug connector of the embodiment of the disclosure.

In the aforementioned embodiment, the connecting portions 14 are formed by using laser welding technique, but embodiments are not limited thereto. Please refer to FIG. 5, which is another schematic front view of the metal shell 13 of the micro electronic plug connector 100 of the embodiment of the disclosure. In some implementation aspects, the top lateral wall 131 further includes a breach 1312, and the connecting portion 14 further includes a riveting block 141 disposed at the top plane 1322; additionally, the riveting block 141 extends through the breach 1312, thereby rivetingly connected to the top lateral wall 131 with the top of the riveting block 141 being deformed, so that the riveting block 141 is fastened within the breach 1312 to improve the structural strength of the micro electronic plug connector 100 and reducing EMI.

In the disclosure, the connecting portion is applied to connect the top lateral wall with the top plane, thus preventing the top lateral wall or the bottom lateral wall from being deformed or damaged; that is, with the connection of the connecting portion, the top lateral wall and the bottom lateral wall are integrally formed as a whole to strengthen the structural strength between the top lateral wall and the bottom lateral wall and to improve the overall strengths of the first frame window and the second frame window. Additionally, the connecting portion absorbs and grounds the electronic interference generated upon transmitting USB 3.0 and USB 2.0 signals, and prevents from the EMI problems upon transmitting USB 3.0 and USB 2.0 signals simultaneously.

While the disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A micro electronic plug connector, comprising:

an insulation housing, comprising a base member, a first tongue plate and a second tongue plate, the first tongue plate and the second tongue plate extendingly formed at one side of the base member;

a first terminals, disposed at the first tongue plate;

a second terminals, disposed at the second tongue plate;

a metal shell, enclosing the insulation housing, the metal shell comprising:

a top lateral wall, and a bottom lateral wall, being arranged side by side with the top lateral wall to form a first frame window and a second frame window, the first tongue plate received in the first frame window, the second tongue plate received in the second frame window, the bottom lateral wall comprising a protruding portion disposed between the first frame window and the second frame window, the protruding portion comprising a top plane, the top plane being adjacent to the top lateral wall, an interval being defined between the top lateral wall and the top plane; and a connecting portion, disposed at the interval, the top lateral wall and the top plane being connected with each other through the connecting portion.

2. The micro electronic plug connector according to claim 1, wherein the top lateral wall is formed as the connecting portion by using laser welding.

3. The micro electronic plug connector according to claim 1, wherein the top lateral wall comprises a plurality of recessed portions adjacent to the top plane, a distance between each of the recessed portions and the top plane is smaller than the interval, the recessed portions are formed as a plurality of connecting portions by using laser welding.

4. The micro electronic plug connector according to claim 1, wherein the top lateral wall comprises a breach, the connecting portion comprises a riveting block, and the riveting block is disposed at the top plane and rivetingly connected to the breach.

5. The micro electronic plug connector according to claim 1, wherein the first terminals comply with an interface for transmitting USB 3.0 signals.

6. The micro electronic plug connector according to claim 1, wherein the first terminals comply with an interface for transmitting RF signals.

7. The micro electronic plug connector according to claim 1, wherein the second terminals comply with an interface for transmitting USB 2.0 signals.

8. The micro electronic plug connector according to claim 1, wherein the second terminals comply with an interface for transmitting digital signals.

* * * * *